US005263012A

United States Patent [19]

Muirhead

[11] Patent Number: 5,263,012

[45] Date of Patent: Nov. 16, 1993

[54] SUB-NANOSECOND TIME DIFFERENCE MEASUREMENT

[75] Inventor: James O. Muirhead, Torrance, Calif.

[73] Assignee: Hughes Aircraft Company, Los Angeles, Calif.

[21] Appl. No.: 818,314

[22] Filed: Jan. 8, 1992

[51] Int. Cl.[5] ..... G04F 8/00; G04F 10/00

[52] U.S. Cl. ..... 368/119

[58] Field of Search ..... 368/113-120; 324/83 R; 364/569, 575; 377/16, 19, 20

[56] References Cited

U.S. PATENT DOCUMENTS 2,738,461 3/1956 Burbeck et al. ..... 368/119
4,164,648 8/1979 Chu ..... 368/119
4,165,459 8/1979 Curtice ..... 368/119
4,383,166 5/1983 Chu et al. ..... 377/20
4,569,599 2/1986 Bolkow et al. ..... 368/120
4,613,951 9/1986 Chu ..... 368/120
4,654,836 3/1987 Wason ..... 324/83 FE
4,881,121 11/1989 Judge ..... 358/10
4,942,561 7/1990 Ohishi et al. ..... 368/118

*Primary Examiner*—Vit W. Miska

[57] ABSTRACT

An analog system (100) of measuring the difference in time of occurrence of events. The method uses two coherent oscillators (110, 116) of the same frequency which start with predetermined phase when each of the events are detected. The phase difference of the oscillators (110, 116) is a measure of the difference in the time of occurrence of the two events.

17 Claims, 1 Drawing Sheet

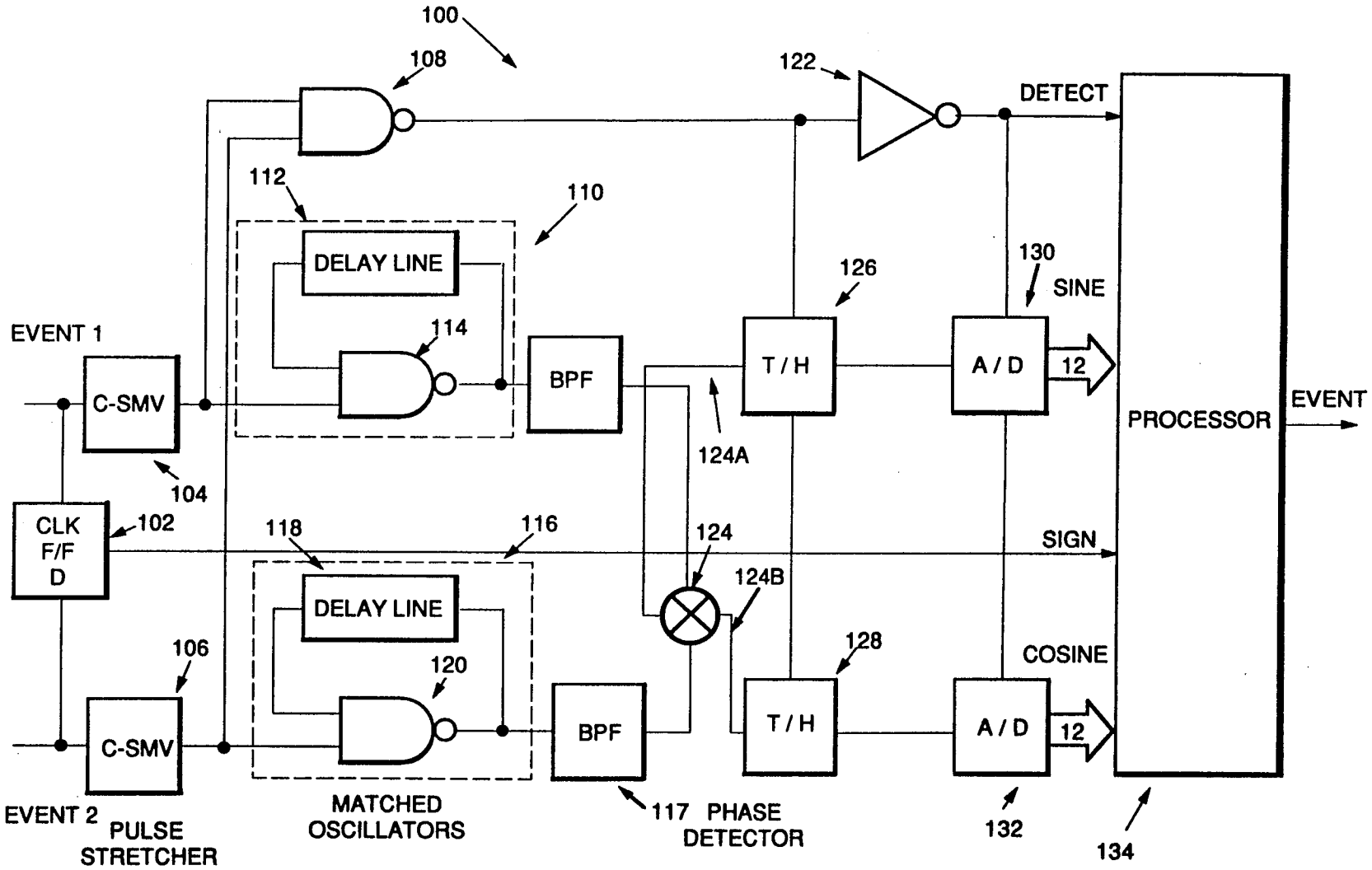
EVENT
PROCESSOR
134
DETECT
SINE
12
130
A / D
SIGN
COSINE
12
A / D
132
122
126
T / H
128
T / H
124A
124
124B
117 PHASE DETECTOR
BPF
BPF
110
116
100
108
DELAY LINE
114
DELAY LINE
120
MATCHED OSCILLATORS
112
118
104
C-SMV
102
CLK F/F D
106
C-SMV
EVENT 1
EVENT 2
PULSE STRETCHER

SUB-NANOSECOND TIME DIFFERENCE MEASUREMENT

BACKGROUND OF THE INVENTION

This invention relates to an analog technique of measuring the difference in time of occurrence of events.

Current techniques for measuring the difference in time of occurrence of events such as arrival of electromagnetic energy at receivers employ advanced high speed, digital counters with resolution limited by the maximum clock frequency of the current state of the art. Angle measurements are often obtained by the use of phased arrays or rotating narrow beam antennas.

It is therefore an object of the present invention to provide a system for very accurate measurement of the difference in time of occurrence of two events.

SUMMARY OF THE INVENTION

An analog method of measuring the difference in time of occurrence of events is described. The method uses two coherent oscillators of the same frequency which start with predetermined phase when each of the events are detected. The phase difference of the oscillators is a measure of the difference in the time of occurrence of the two events.

This method of measuring time differences of events can be used to measure events such as the arrival of radio frequency signals at closely based receivers in order to determine the direction of a transmitter from the receivers. The invention will allow the use of broad band receivers as well as tuned, narrow band receivers. This analog method has essentially infinite resolution and is limited only by system noise and the linearity of the devices used in the implementation.

The invention is further characterized by a system for measuring the difference in time of occurrence of first and second event signals. The system includes first and second coherent oscillators for generating respective first and second oscillator signals at substantially the same, known oscillator radian frequency. A means is provided for triggering operation of the first oscillator in response to receipt of the first event signal. Another means is provided for triggering operation of the second oscillator in response to receipt of the second event signal. The system further includes a means for measuring the phase difference between the operation of the first and second oscillators after receipt of the first and second event signals.

The difference in time of occurrence of the two event signals is determined in dependence on said phase difference and said oscillator frequency, e.g., by a processor.

BRIEF DESCRIPTION OF THE DRAWING

These and other features and advantages of the present invention will become more apparent from the following detailed description of an exemplary embodiment thereof, as illustrated in the accompanying drawing, in which:

FIG. 1 is a schematic diagram illustrating a time of arrival difference measurement system embodying the present invention.

DETAILED DESCRIPTION OF THE PREFERRED EMBODIMENT

FIG. 1 illustrates a system embodying the invention. This embodiment uses coherent delay line oscillators for simplicity, although any oscillator which starts at zero degrees on the leading edge of a gate will work. The maximum time difference that can be measured is equal to or less than the period of the oscillators. If the time period to be measured is greater than the period of the oscillators, the oscillators will at some point suffer from drift since, as can be seen from the drawings, they are not locked to a reference oscillator. (i.e. are unlocked). However, several devices at different frequencies working in parallel can be used to extend the time difference range when desired. For instance, a parallel device operating at one tenth of the frequency of the first would extend the range of the time difference measurement by a factor of ten. The lower frequency device would provide the coarser time difference measurement while the higher frequency device would provide the fine time difference measurement. Further parallel devices, each with frequencies reduced by a factor of ten from the previous, would increase the range of the measurement even further.

The system 100 of FIG. 1 is responsive to two event signals, indicated as "EVENT 1" and "EVENT 2." A D-type flip-flop device 102 is responsive to these two signals, with EVENT 1 serving as the clock signal to the device, and EVENT 2 serving as the data input signal for the device. EVENT 1 also provides the input to a first one-shot multivibrator (OSMV) device 104. EVENT 2 also provides the input to a second OSMV device 106. OSMVs 104 and 106 provide pulse stretching functions.

The outputs of the respective OSMV devices 104 and 106 are provided as inputs to NAND gate 108, and to respective matched coherent oscillators 110 and 116. A coherent oscillator in this context is an oscillator that starts synchronously with the leading edge of the enabling gate signal. Therefore, the phase of the oscillator at any time T after the enabling gate signal will always be the same. Because the oscillators operate at very nearly the same frequency, the phase relationship of the two oscillators will be a function of only the difference of the starting times of the oscillators.

Oscillator 110 comprises a delay line 112 and NAND gate 114. The delay line 112 is connected to the output of the gate 114. The inputs to the gate 114 are the output of the OSMV 104 and the output of the delay line 112. Oscillator 116 comprises a delay line 118 and NAND gate 120. The delay line 118 is connected to the output of the gate 120. The inputs to the gate 120 are the output of the OSMV 106 and the output of the delay line 118.

The output of a NAND gate is low only when both inputs are high. The output of the delay line represents the value of the input to the delay line after a period equal to the delay of the line. In other words, the output of the delay line is retarded from the input by a time equal to the electrical length of the delay line. Initially, the input from the OSMV is low, the output of the NAND gate is therefore high and the input from the delay line is high. When the NAND gate input from the OSMV goes high, the output of the NAND gate immediately goes low because the input from the delay line is still high. After a time equal to the delay period of the delay line, the NAND gate input from the delay lines goes low causing the NAND gate output to go immediately high. Again after a period equal to the delay line delay, the output of the delay lines goes high, causing the NAND gate output to go low. This cyclic activity continues until the output of the OSMV goes low causing the output of the OSMV to go high.

The output of the oscillator 110 is passed through a bandpass filter 113. The output of the oscillator 116 is passed through a bandpass filter 117. The outputs of delay line multivibrators, such as oscillators 110 and 116, are square waves with a D.C. offset. The bandpass filters 113 and 117 are required to remove the harmonics and D.C. offset when using delay line multivibrators for the coherent oscillators. The bandpass filters are not required when sine wave oscillators are used.

The outputs of the matched oscillators 110 and 116 are provided to the phase detector 124. The outputs 124A and 124B of the phase detector 124 represent the sine and cosine of the phase difference between the two event signals EVENT 1 and EVENT 2.

The system 100 further comprises respective track and hold amplifiers (T/H) 126 and 128 controlled by the output of the NAND gate 108. The outputs of the T/H devices 126 and 128 are provided to the respective analog-to-digital converters (A/D) 130 and 132. The track and hold amplifiers are used to retain the values of the outputs 124A and 124B of the phase detector 124 for a time sufficient for the analog-to-digital converters to complete the conversion process.

To illustrate the operation of the system 100, consider the example wherein the input signal EVENT 1 occurs first. Because the clock leading edge of the flip-flop 102 occurs prior to the signal EVENT 2 appearing at the d input of the flip-flop 102, the output of device 102 is a low signal. Had EVENT 2 occurred first, the output of the flip-flop 102 would go to a high signal. Thus, the state of the flip-flop output indicates the sign of the phase difference between the two event signals, i.e., whether EVENT 1 leads or lags EVENT 2. The first OSMV 104 in this example goes "high" first starting the first coherent oscillator (COHO) 110.

When EVENT 2 occurs, the second OSMV 106 goes high and starts the second COHO 116 which is now behind in phase with respect to the first COHO 110 by the radian frequency of the COHOs times the time difference between the two events, i.e., radian phase angle = time difference/radian frequency.

The outputs of the two COHOs 110 and 116 are input to the phase detector 124 which outputs the sine and cosine of the phase difference between them.

The states of the OSMVs 104 and 106 control the output state of the NAND gate 108 which puts the track and hold amplifiers (T/H) 126 and 128 in "track" mode when both OSMVs are high. When either OSMV goes low, the T/Hs 126 and 128 assume the hold state and a convert command is given to the analog-to-digital converters (A/D) 130 and 132. The digital outputs of sine and cosine of the phase difference from the A/D devices 130 and 132 are then used to calculate the time difference of the two events from the known period of the COHOs, 110 and 116, i.e., time difference = radian phase angle/radian frequency.

The detect output, i.e., the output of the NAND gate 108 as inverted by inverter 122, is used to signal a processor 134 that the digital phase data has been taken for a pair of events. The processor 134 performs the calculation of the time difference from the known period of the COHOs and the measured radian phase angle, and outputs to a utilization apparatus information indicative of the time difference between occurrence of EVENT 1 and EVENT 2.

The period of the OSMVs 104 and 106 need only be long enough for the outputs 124A and 124B of the phase detector 124 to rise fully. The periods of the OSMVs should be matched well for good design practice, but close matching is not critical to proper operation.

When the maximum possible time difference of arrival is less than one-half the period of the oscillators, the phase difference will always be less than $\pi/2$ and there can be no ambiguity as to which event occurred first. When the time difference of arrival may exceed one-half the period of the oscillator, flip-flop 102 is used to determine which event occurred first. The output of the flip-flop 102 is not required where the difference in time of the events is less than half the period of the COHOs 110 and 116. This allows the use of logic with relatively long input setup times. The setup time required of the flip-flop 102 is typically approximately one-half the period of the COHOs 110 and 116. The setup times of the NAND gate 108 and the inverter 122 are not critical and may also be as long as one-half the period of the COHOs 110 and 116.

For input pulses that are sufficiently long for the output of the phase detector 124 and the T/Hs 126 and 128 to stabilize, the OSMVs 104 and 106 are not required and the inputs can go directly to the COHOs 114 and 116 and the NAND gate 108. The OSMVs 104 and 106 function as pulse stretchers to keep the COHOs 110 and 116 operating for a time sufficient for the outputs of the phase detector 124 to rise fully. Where the widths of the event pulses are greater than the rise time of the phase detector outputs, pulse stretching is not required. The width of the event pulses is a function of the application of the device. Measurement of atomic decay events would require pulse stretching, while measuring the difference in times of arrival of radar pulses probably would not.

The COHOs 110 and 116 must be closely matched. "Closely matched" means that the oscillation frequencies of the respective COHOs 110 and 116 should agreed to within approximately 0.01 percent for the best accuracy. Because the oscillators are allowed to run for the period of the OSMVs 104 and 106, they will accumulate a phase difference that is a function of the frequency difference and the period of the OSMV in addition to the phase difference caused by the difference in time of occurrence of the two events. While this error may be calibrated and removed after the fact, it would be more practical to simply match the oscillators well.

The accuracy of phase detector 124 is determined by the required resolution of the time difference measurement.

The resolution of the system 100 is limited only by the number of bits in the digital-to-analog converters 103 and 132 and the degree to which a few components can be matched. The components that require close matching are the OSMVs 104 and 106. The threshold and output rise times should be well matched. This is easily achieved by fabricating both OSMVs on the same substrate. NAND gates 114 and 120 should also have matched input trigger thresholds and output rise times. Again, fabricating them on the same substrate should yield the required matching. The delay lines 112 and 118 should be matched in terms of delay time and frequency response. This close matching of components and the use of common substrates will enable the two channels to track one another over wide changes in temperature. However, maintaining the device at a constant temperature will provide the ultimate accuracy.

While the invention has been described in the context of measuring the time difference of arrival of two different events, it can readily be extended to measuring time differences of arrival of three or more events, wherein a separate oscillator channel is provided for each event, and the phase differences between and among the respective channels are measured.

Using this system, an array of three omni-directional receivers only a few meters apart would provide the direction of arrival of RF energy with greater accuracy and potentially at much less cost.

The invention has application in electronic support measures aboard naval ships and in tactical direction finders. It could be incorporated into electronic warfare receivers. The invention can be incorporated into laboratory test equipment to provide improved accuracy in time difference measurement. When used in conjunction with munitions that emit a burst of radio frequency energy on impact, as described in pending U.S. application Ser. No. 07/798,480, filed Nov. 26, 1991, entitled "Radio Frequency Device for Marking Munition Impact Point," by J. O. Muirhead et al. and assigned to a common assignee with the present invention, it can be used in a scoring system to locate the point of impact or in tactical system to designate targets for artillery or aircraft attack.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of measuring the difference in time of occurrence of two events, comprising the following steps:

starting a first oscillator of a known oscillator frequency when the occurrence of the first of said events is detected;

starting a second oscillator of said known oscillator frequency when the occurrence of the second of said events is detected;

measuring the phase difference between the operation of said first and second oscillators; and determining the difference in time of occurrence of said two events from the ratio of said measured phase difference to said oscillator frequency.

2. The method of claim 1 wherein said two events are respectively characterized by first and second event signals, and the operation of said first and second oscillators is triggered upon the receipt of said respective first and second event signals.

3. The method of claim 1 wherein said step of determining said time difference comprises computing the ratio of said phase difference in radians and the known oscillator frequency in radians.

4. The method of claim 1 wherein said first and second oscillators are further characterized as coherent oscillators.

5. A system for measuring the difference in time of occurrence of two events characterized by first and second event signals, comprising:

first and second oscillators for generating respective first and second oscillator radian frequency;

means for triggering operation of said first oscillator in response to receipt of said first event signal;

means for triggering operation of said second oscillator in response to receipt of said second event signal;

means for measuring the phase difference between the operation of said fist and second oscillators after receipt of said first and second event signals; and means for determining the difference in time of occurrence of said two events in dependence on the ratio of said phase difference and said oscillator frequency.

6. The system of claim 5 wherein said first and second oscillator are further characterized as coherent oscillators.

7. The system of claim 5 wherein said means for measuring said phase difference comprises a phase detector circuit responsive to said first and second oscillator signals and providing output signals indicative of said phase difference.

8. The system of claim 7 wherein said phase detector circuit comprises means for outputting a first output signal indicative of the sine of said phase difference, and a second output signal indicative of the cosine of said phase difference.

9. The system of claim 8 further comprising first and second track and hold circuits responsive respectively to said first and second phase detector output signals for tracking said signals and holding the value of said respective signals after both of said event signals have occurred.

10. The system of claim 9 further comprising first and second analog to digital converter circuits for converting said held values of said first and second phase detector output signals into corresponding digital values corresponding to said sine and cosine of said phase difference.

11. The system of claim 10 further comprising a digital processor responsive to said sine and cosine digital values for computing said time difference in dependence on said known oscillator frequency.

12. The system of claim 11 further comprising means responsive to the receipt of said first and second event signals for providing a signal to said processor to enable said computing of said time difference.

13. The system of claim 5 wherein said means for determining said time different comprises means for computing the ratio of said phase difference in radians and said known oscillator radian frequency.

14. The system of claim 5 further comprising means for indicating whether said first event signal leads or lags said second event signal.

15. The system of claim 14 wherein said indicating means comprises a d-type flip-flop circuit having a data input, a clock input and an output, and wherein said first event signal is connected to said clock input, said second event signal is connected to said data input, and wherein said flip-flop output provides a signal indicating whether said first event signal leads or lags said second event signal.

16. The invention of claim 1 wherein said oscillators are unlocked.

17. The invention of claim 5 wherein said oscillators are unlocked.

* * * * *